US006708605B2

(12) United States Patent
Liu et al.

(10) Patent No.: US 6,708,605 B2
(45) Date of Patent: Mar. 23, 2004

(54) STRAP RESERVING CONTROL DEVICE FOR A STRAPPING MACHINE

(75) Inventors: Chin-Chang Liu, Taichung (TW); Chi-jan Su, Taipei (TW)

(73) Assignees: Tekpak Corporation, Taichung (TW); Transpak Equipment Corp., Taipei (TW)

( * ) Notice: Subject to any disclaimer, the term of this patent is extended or adjusted under 35 U.S.C. 154(b) by 0 days.

(21) Appl. No.: 10/215,333

(22) Filed: Aug. 9, 2002

(65) Prior Publication Data

US 2004/0025718 A1 Feb. 12, 2004

(51) Int. Cl.[7] ..... B65B 13/04; B65H 43/08; G05D 15/00

(52) U.S. Cl. ..... 100/4; 100/26; 53/589; 226/26; 226/118.4

(58) Field of Search ..... 100/4, 8, 26, 29, 100/32; 53/67, 74, 494, 589; 226/26, 118.2, 118.4; 242/564.3, 418.1

(56) References Cited

U.S. PATENT DOCUMENTS 2,792,615 A * 5/1957 Cohn et al. ..... 26/18.5
2,797,086 A * 6/1957 Cohn et al. ..... 226/26
3,137,426 A * 6/1964 Brenneisen ..... 226/10
3,890,547 A * 6/1975 Keck ..... 318/6
4,015,452 A * 4/1977 Kreitz ..... 68/175
4,440,003 A * 4/1984 Koch ..... 68/22 R
5,079,899 A * 1/1992 Kurachi ..... 53/399
6,038,967 A * 3/2000 Chak et al. ..... 100/2

* cited by examiner

*Primary Examiner*—Allen Ostrager
*Assistant Examiner*—Jimmy Nguyen
(74) *Attorney, Agent, or Firm*—Troxell Law Office PLLC

(57) ABSTRACT

A strap reserving control device for a strapping machine is to apply the relative action between a balancing weight unit and a balancing rod respectively fixed at the opposite ends of a rotating shaft, and the functions of sensing by a sensing portion of a sensing switch to control the amount of packaging strap stored in a strap reserving room. The balancing weight unit and the balancing rod is formed with a lever structure therebetween, therefore no tiredness of elasticity or damage may happen to them, able to prolong the service life of the machine, and stably and precisely control the amount of packaging strap stored in the strap reserving room.

3 Claims, 9 Drawing Sheets

STRAP RESERVING CONTROL DEVICE FOR A STRAPPING MACHINE

BACKGROUND OF THE INVENTION

This invention relates to a strap reserving control device for a strapping machine, particular to one able to quickly adjust and stably control the length or amount of the packaging strap stored in a strap reserving room A conventional strapping machine has a strap reserving control device for controlling a preset length of a packaging strap stored in a strap reserving room to let the packaging strap guided out for strapping an object such as a carton.

The conventional strap reserving control device 10, as shown in FIGS. 1 and 2, has a balancing rod 11 and a press rod 12 respectively secured at the opposite ends of a rotating shaft 13. The rotating shaft 13 is pivotally inserted in a shaft sleeve 14 at the outer side of a separating plate 21 of a strap reserving room 20, letting the balancing rod 11 and the press rod 12 respectively positioned at the inner side and the outer side of the separating plate 21. Then, the shaft sleeve 14 is secured around with a fixed base 15 having one side extending outward and making up a support frame 151, which is provided with a micro-switch 16 on one side, and a twisting spring 17 and a stop rod 18 on the front side 152. The twisting spring 17 has its lower end extending downward and forming a hook 171 for holding the bottom edge of the support frame 151, and its upper end provided with a press-stopping member 172 extending horizontally above the stop rod 18, with the bottom edge of the and of the press rod 12 pressing on the press-stopping member 172 to avoid the press rod 12 pressing directly on the press button 161 of the micro-switch 16.

In operating, as shown in FIGS. 3, 4 and 5, firstly, start a strap feed device 40 to guide the packaging strap 30 to move into the strap reserving room 20 along the top edges of the balanced rods 11, with the packaging strap arranged to overlie on the left side and the right side on the balancing rods 11. At this time, in case the total weight of the packaging strap 30 in the strap reserving room 20 and the overlying tension therebetween is larger than the resilience of the press-stopping member 171, the balancing rods 11 will be pressed downward and the rotating shaft 13, by interaction, will synchronously actuate the press rod 12 to incline downward. Simultaneously, the bottom edge of the end of the press rod 12 will press on the press-stopping member 172 as well as on the press button 161 of the micro-switch 16, which immediately sends out a signal to turn off the power of the strap feed device 40 to stop guiding the packaging strap into the strap reserving room 20, thus finishing one round of strap reserving.

On the contrary, when the packaging strap 30 in the strap reserving room 20 is guided out for strapping an article to be strapped, the force on the balancing rods 11 vanishes, and the press-stopping member 172 recovers its resilience, pushing the press rod 12 to incline upward to separate from the press button 161 of the micro-switch 16, which in the mean time sends out a signal to turn on the power of the strap feed device 40, which is then started to guide the packaging strap 30 again into the strap reserving room 20 for strapping in a next round.

However, in a conventional strap reserving control device 10, the twisting spring 17 controls the strap-reserving amount in the strap reserving room 20 by its resilience. Under this condition, if a strapping machine is in use, the press-stopping member 172 of the twisting spring 17 will be pressed repeatedly by the press rod 12, and hence the twisting spring 17 is liable to become tired in its elasticity and loose, weakened and even damaged, not only shortening the service life of the machine, but also failing to stably control the length or amount of the packaging strap guided in the strap reserving room 20, and even resulting in insufficient supply of a packaging strap in the strap reserving room 20. Besides, the resilience of the twisting spring 17 is constant and impossible to be adjusted so the strap reserving amount set in the strap reserving room 20, which is controlled by the twisting spring 17, can not be adjusted by the strap reserving control device 10.

SUMMARY OF THE INVENTION

The objective of the invention is to offer a strap reserving control device for a strapping machine, applying a lever structure formed between a balancing weight device and a balancing rod to stably control the length or amount of the packaging strap stored in a strap reserving room, able to prolong the service life of the machine and lower cost for maintenance and repair.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
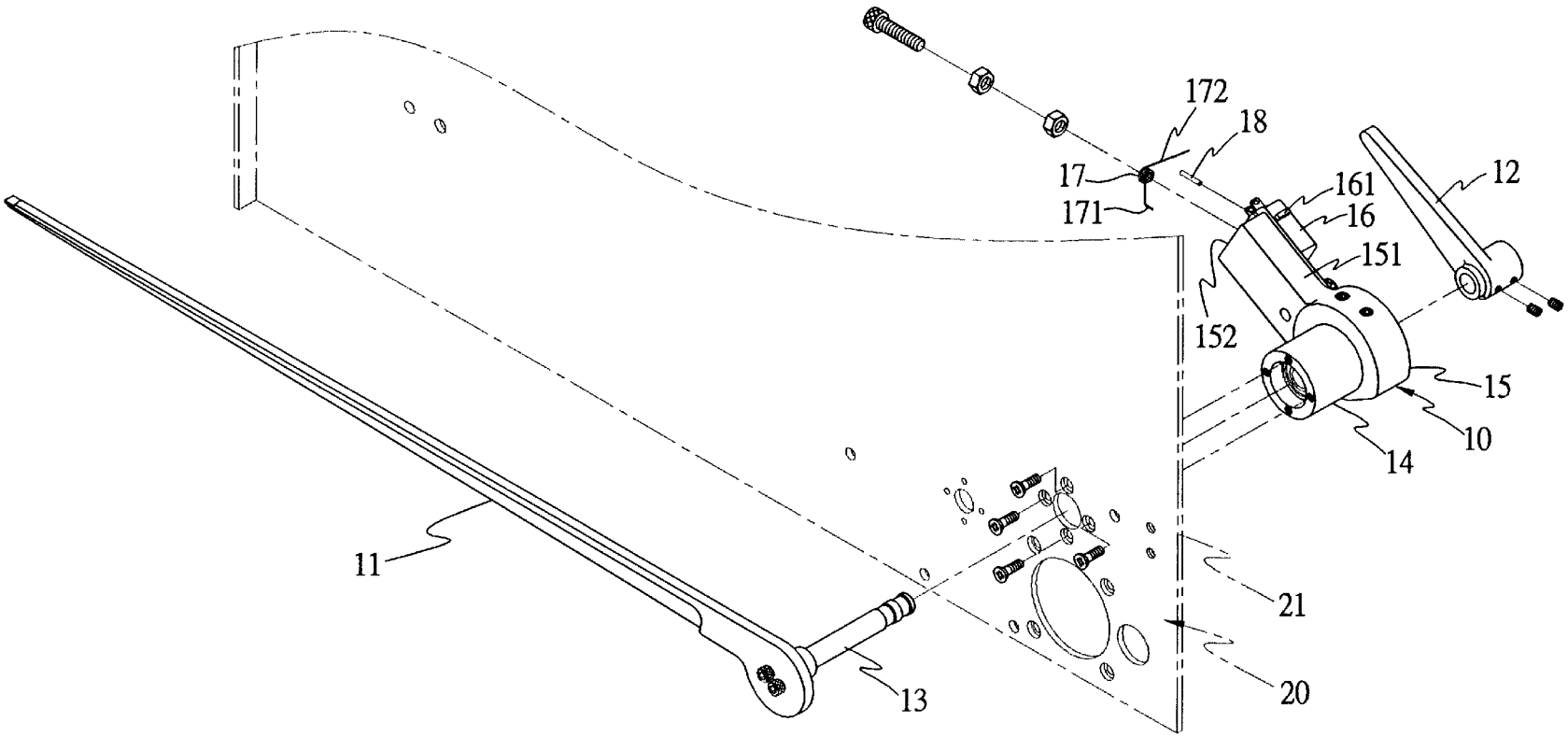
FIG. 1 PRIOR ART
FIG. 1 is an exploded perspective view of a conventional strap reserving control device.
Figure 2:
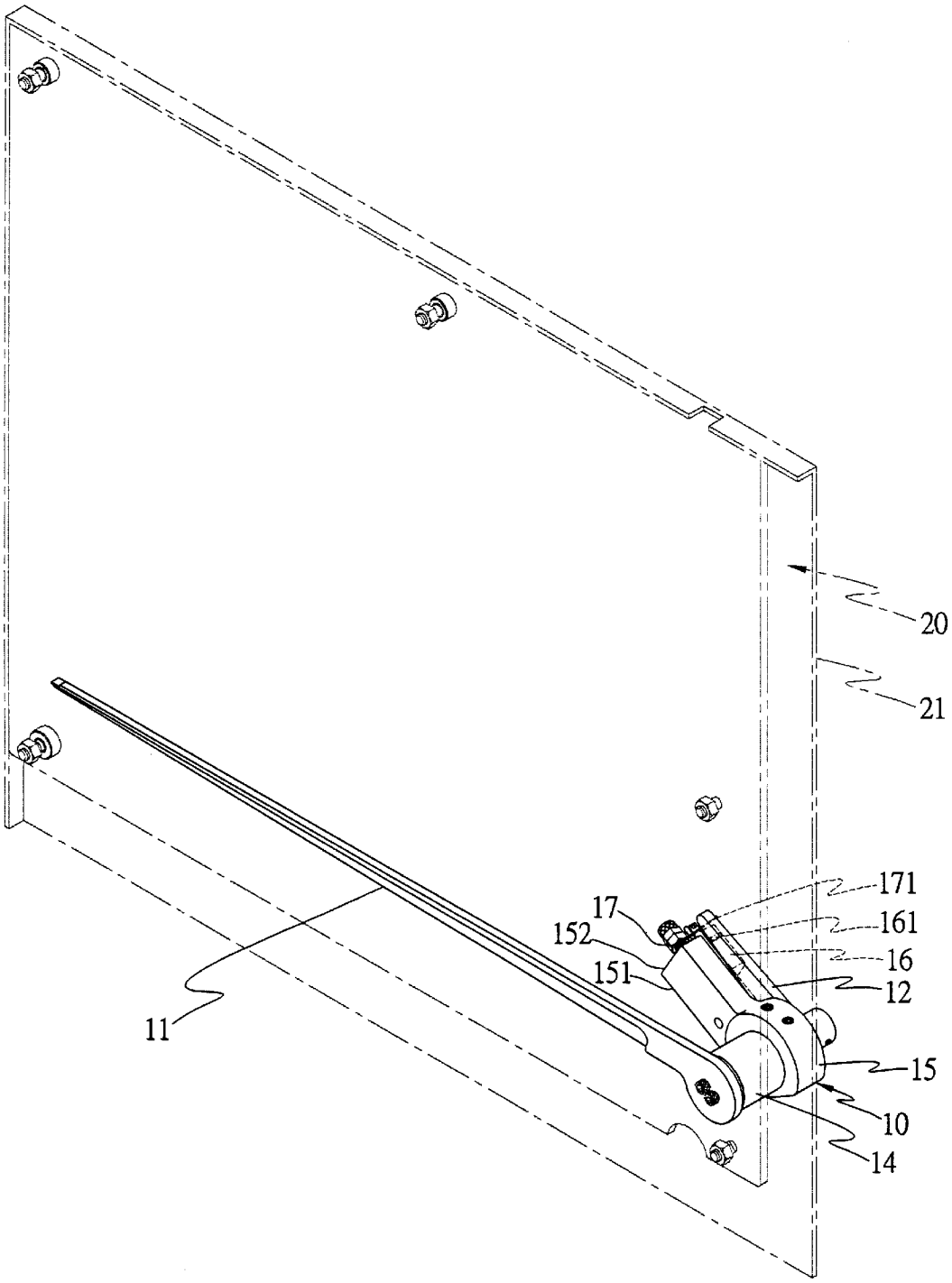
FIG. 2 PRIOR ART
FIG. 2 is a perspective view of the conventional strap reserving control device.
Figure 3:
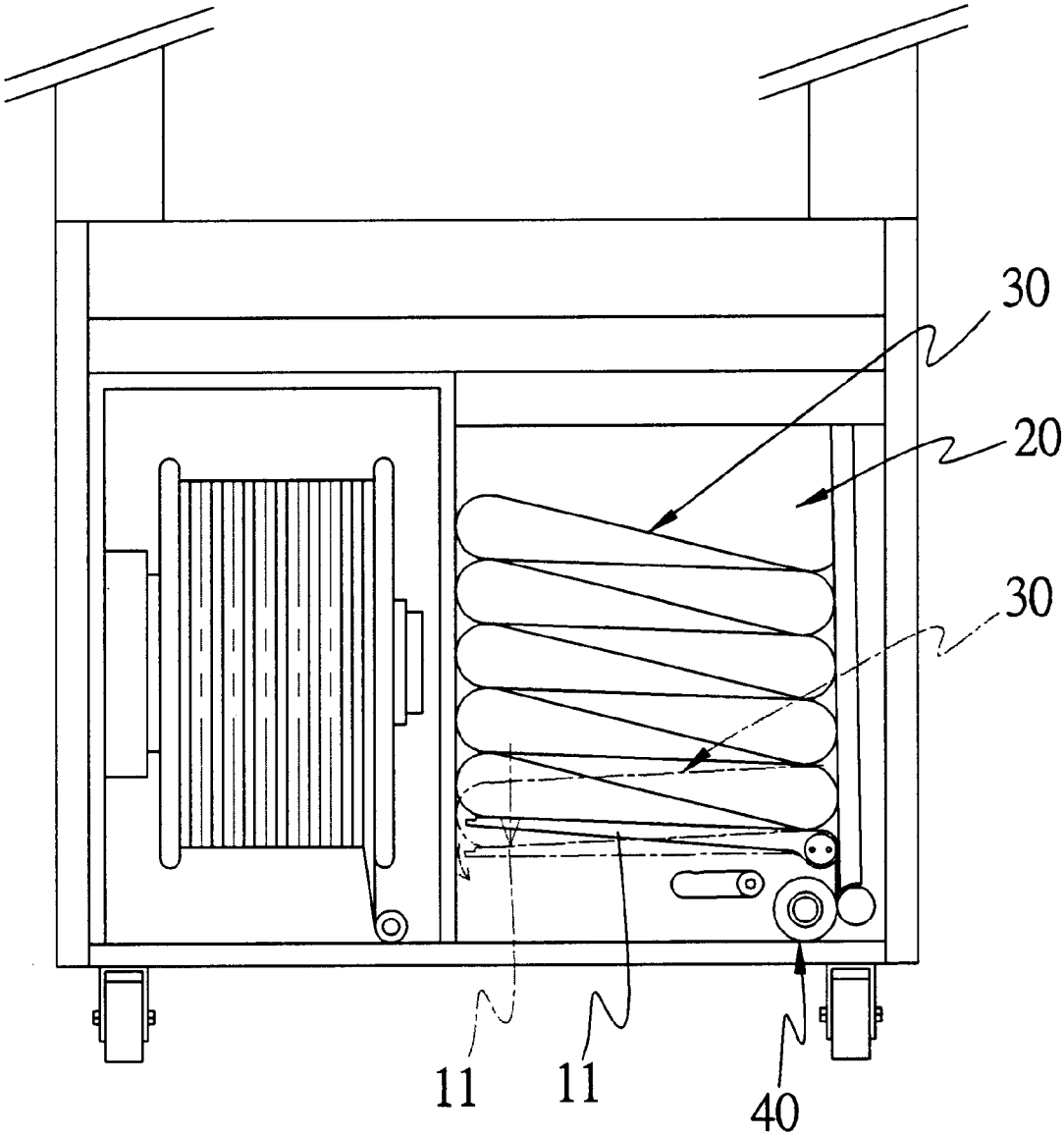
FIG. 3 PRIOR ART
FIG. 3 is a side view of the conventional strap reserving control device, illustrating a balanced rod pressed downward by the packaging strap stored in a strap reserving room.
Figure 4:
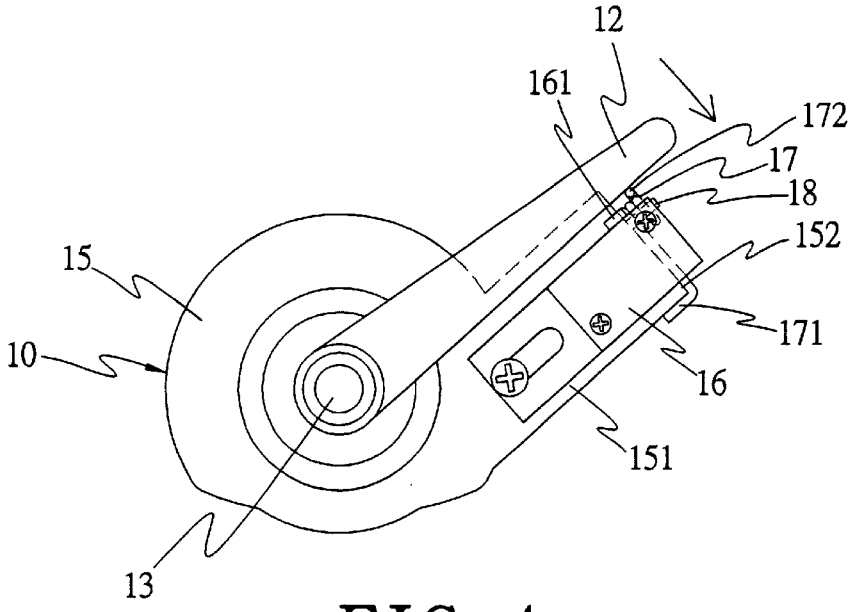
FIG. 4 PRIOR ART
FIG. 4 is a side view of the conventional strap reserving control device, illustrating the balanced rod actuating a press rod to operate.
Figure 5:
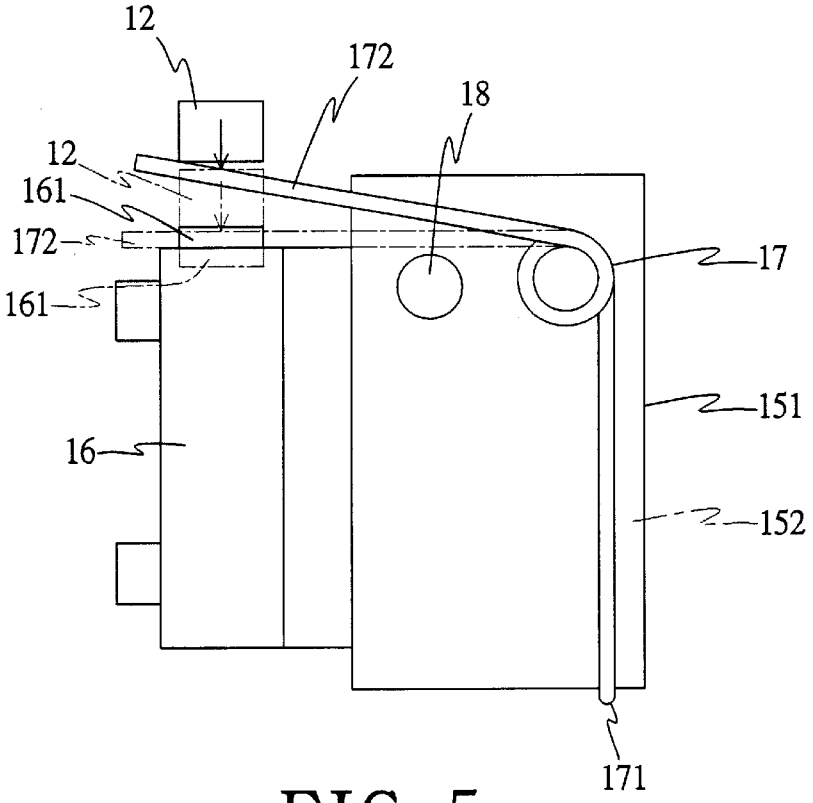
FIG. 5 PRIOR ART
FIG. 5 is a rear view of the conventional strap reserving control device, illustrating the press rod pressing on the press button of a micro-switch.
Figure 6:
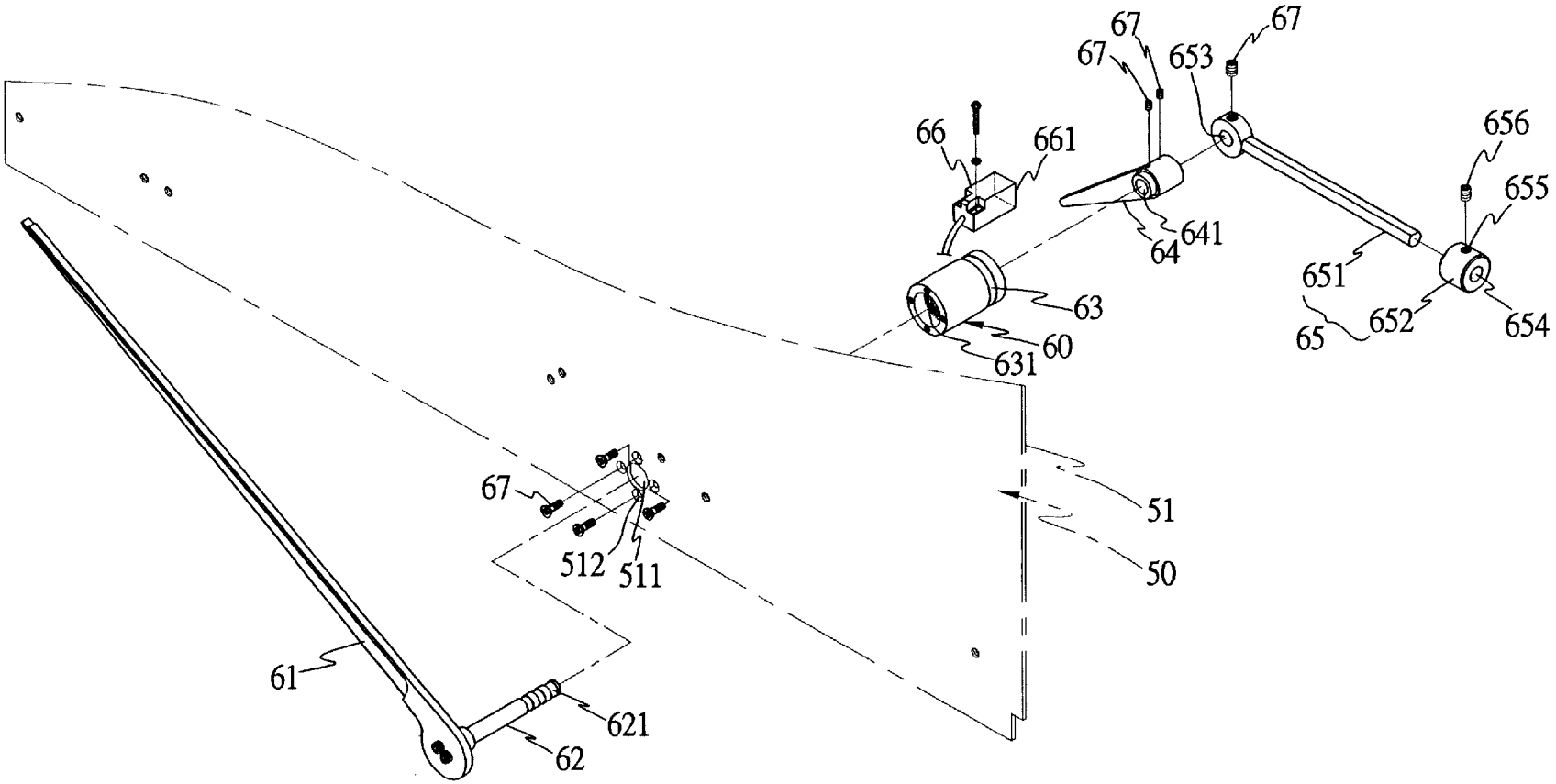
FIG. 6 is an exploded perspective view of a preferred embodiment of a strap reserving control device in the present invention.
Figure 7:
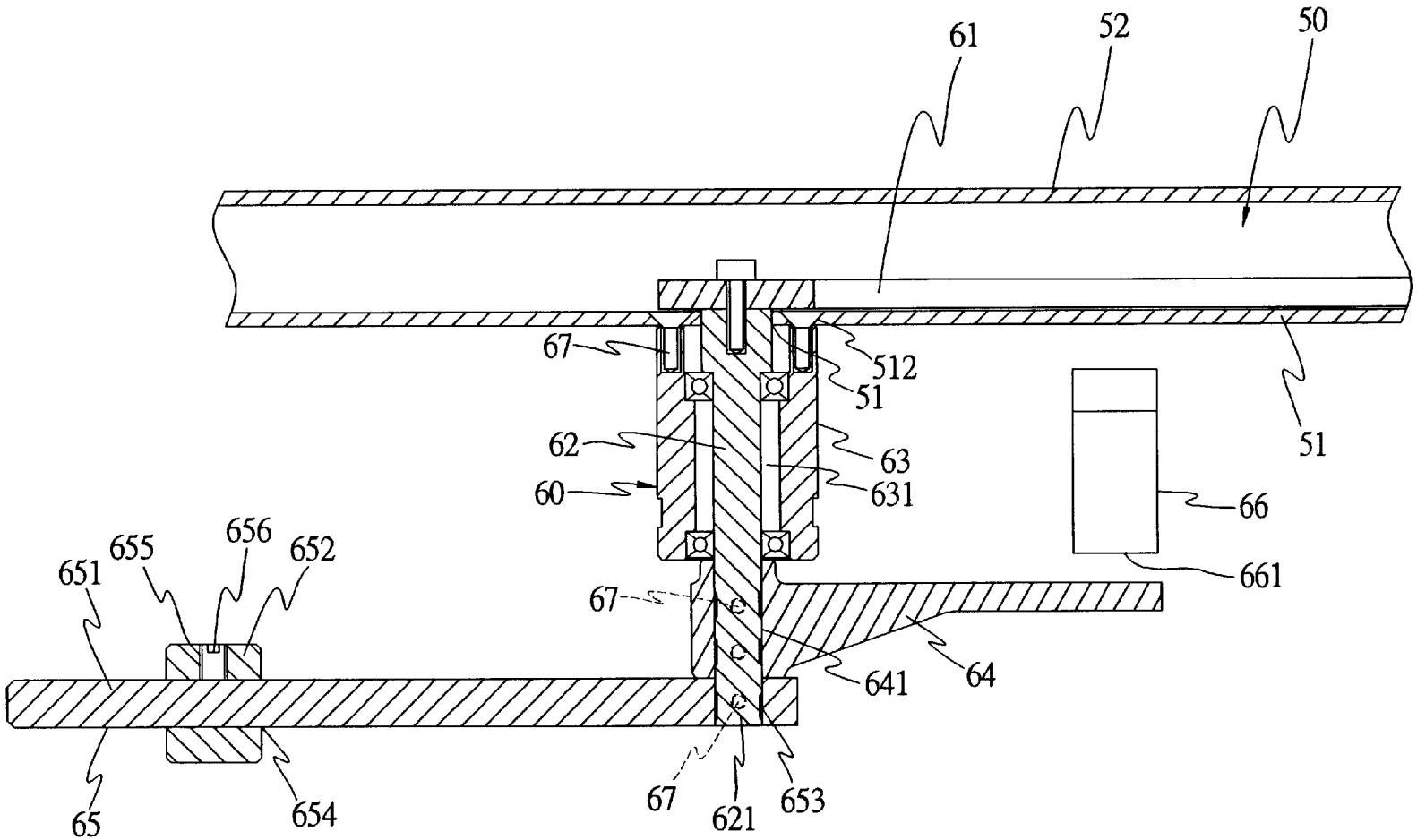
FIG. 7 is an upper view of the preferred embodiment of the strap reserving control device in the present invention.
Figure 8:
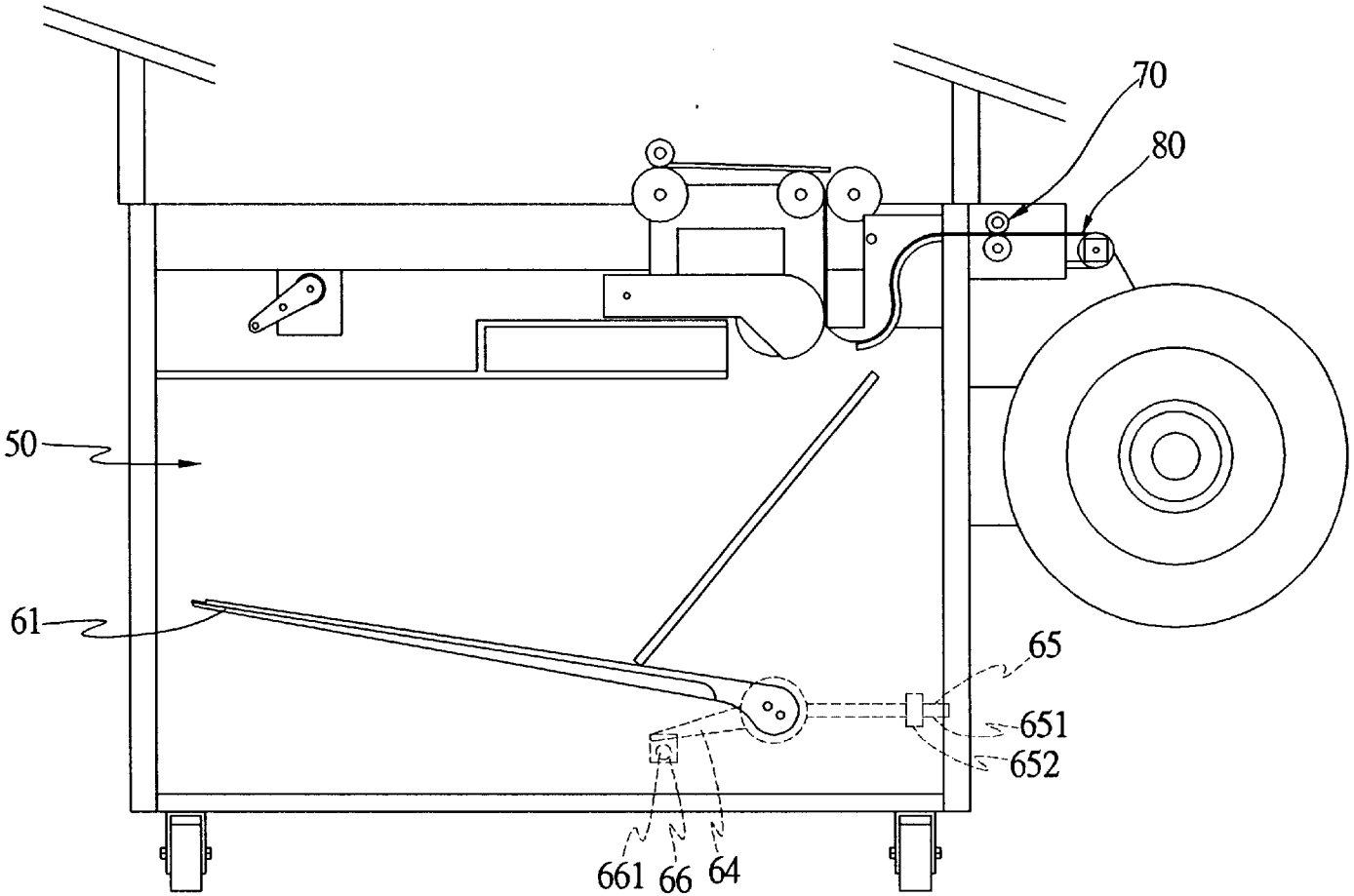
FIG. 8 is a front view of the preferred embodiment of the strap reserving control device, illustrating the locations of a balanced rod, a sensing rod and a balancing weight rod before storing a packaging strap in a strap reserving room in the present invention.

A preferred embodiment of a strap reserving control device for a strapping machine in the present invention, as shown in FIGS. 6, 7 and 8, includes a strap reserving room 50 and a strap reserving control device 60. The strap reserving room 50 is formed by oppositely combining a separating plate 51 with a cover plate 52 with a preset interval. The separating plate 51 is bored with a through hole 511 at a lower right side and a plurality of small holes 512 around the through hole 511. The strap preserving control device 60 consists of a balancing rod 61, a rotating shaft 62, a shaft sleeve 63, a sensing rod 64, a balancing weight unit 65 and a sensing switch 66.

The balancing rod 61 has a proper length, horizontally positioned side wise to the strap reserving room 50.

The rotating shaft 62 has its front end perpendicularly secured at one end of the balance rod 61 and its rear end formed with an engage portion 621. The rotating shaft 62 is inserted through the through hole 511 of the separating plate 51 to extend outward.

The shaft sleeve 63 is shaped cylindrical, threadably fixed on the outer side of the separating plate 51 by means of four combining members 67 screwing through the four small holes 512 of the separating plate 51, and provided axially with a central shaft hole 631 aligned to the through hole 511 for the rotating shaft 62 to be inserted therethrough, with the engage portion 621 of the rotating shaft 62 extending out of the shaft hole 631.

The sensing rod 64 has an axial combining hole 641 in one end for the engage portion 621 of the rotating shaft 62 to be secured therein by two combing members 67, having a predetermined length and located in the same direction of the balancing rod 61.

The balancing weight unit 65 consists of a weight rod 651 and a weight member 652. The weight rod 651 has a lateral fit hole 653 at one end for fixedly receiving the engage portion 621 of the rotating shaft 62 with a combining member 67. Further, the respective arm of force of the weight rod 651 and the balancing rod 62 are positioned in opposite directions, with the rotating shaft 62 acting as a central fulcrum between them. The weight member 652 has a lengthwise fit hole 654 for the weight rod 651 to be inserted therethrough and a diametrical threaded hole 655 communicating with the fit hole 654, having a bolt 656 engaging the threaded hole 655 for fixing the weight member 652 on the weight rod 651 at one of many locations.

The sensing switch 66 being a proximity sensor in this preferred embodiment is positioned adjacent to the sensing rod 64, having a sensing portion 601 at one side facing the sensing rod 64 for sensing and the movement of the sensing rod 64.

Figure 9:
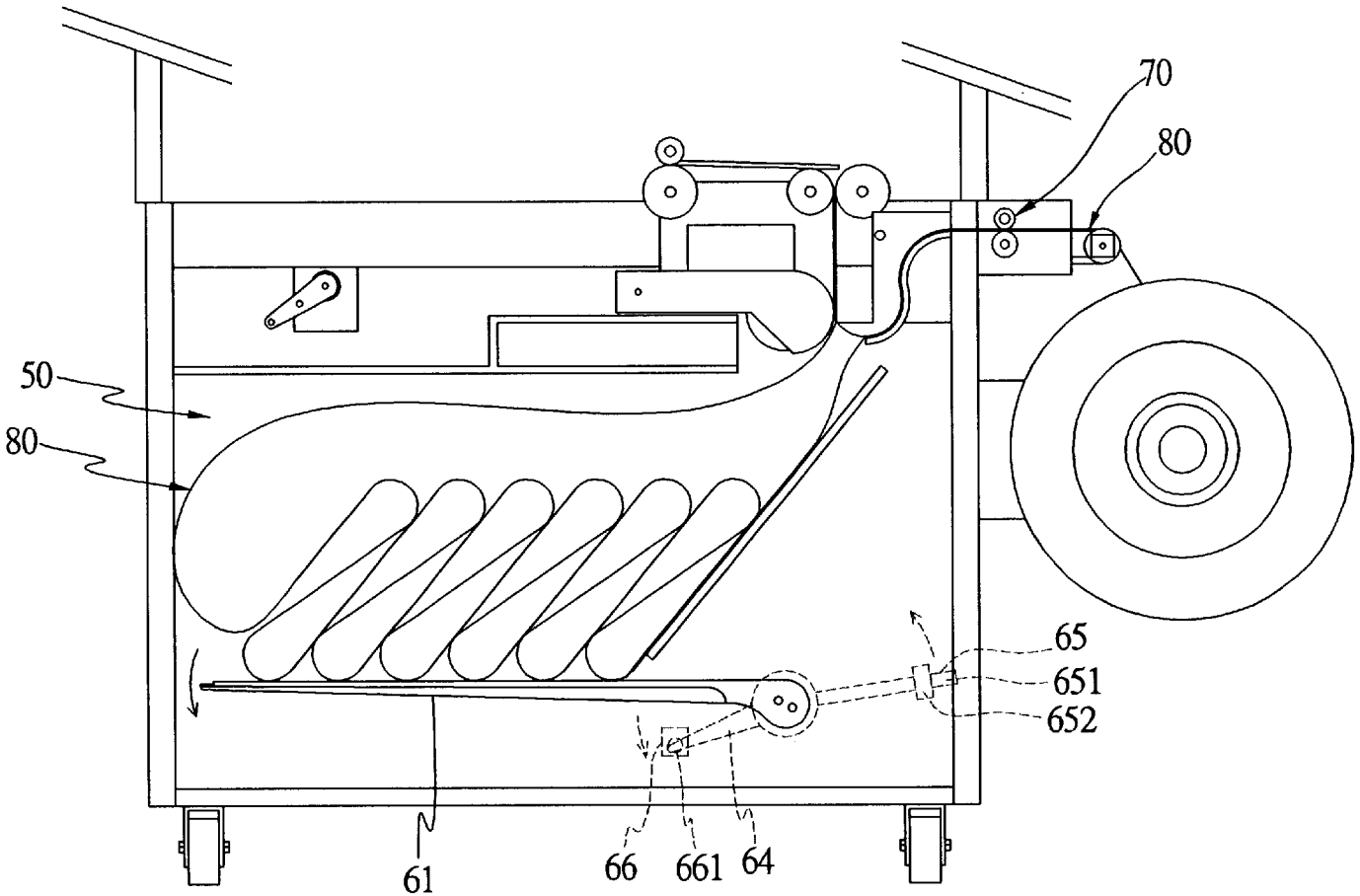
FIG. 9 is a cross-sectional view of the preferred embodiment of the balancing rod, the sensing rod and the weight rod in an operating condition in the present invention.
Figure 10:
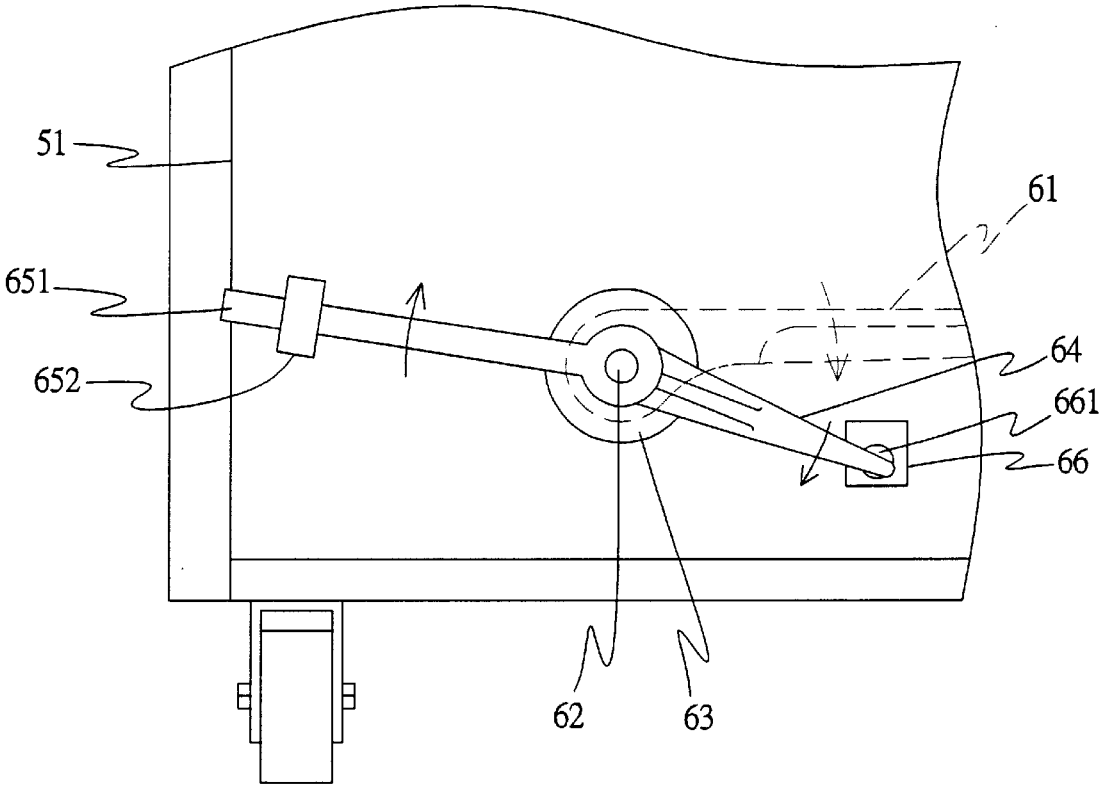
FIG. 10 is cross-sectional view of the preferred embodiment of a sensing switch sensing the action of the sensing rod in the present invention.

In operating, as shown in FIGS. 7, 9 and 10, firstly, the strap feed device 70 is started to guide a packaging strap 80 to move orderly into the strap reserving room 50. When the total weight of the packaging strap 80 in the strap reserving room 50 becomes larger than the preset resisting force of the weight member 652 of the balancing weight unit 65, the weight of the packaging strap 80 will make the balancing rod 61 incline downward, and synchronously the balancing rod 61 will actuate the rotating shaft 62 to move the sensing rod 64 incline downward and force the weight rod 651 incline upward. When the sensing rod 64 shifts to a position nearer to the sensing portion 661, the sensing portion 661 will sense and send out a signal immediately to turn off the power of the strap feed device 70 to stop guiding the packaging strap 80 into the strap reserving room 50 to finish a round of strap preserving.

On the contrary, as shown in FIGS. 8 and 9, when the packaging strap 80 in the strap reserving room 50 is guided out for strapping an article, the weight of the packaging strap 80 pressing on the balanced rod 61 will vanish, and the weight rod 651 will automatically move downward to its original position and the balancing rod 61 as well as the sensing rod 64 will be actuated by the rotating shaft 62 to incline upward to their original locations. Simultaneously, the sensing rod 64 separates from the sensing portion 661 of the sensing switch 66 to interrupt the signal sensed by the sensing portion 661, and the sensing switch 66, with the signal interrupted, turns on the power of the strap feed device 70 to let it guide the packaging strap 80 again into the strap preserving room 50 for strapping for a next round.

Figure 11:
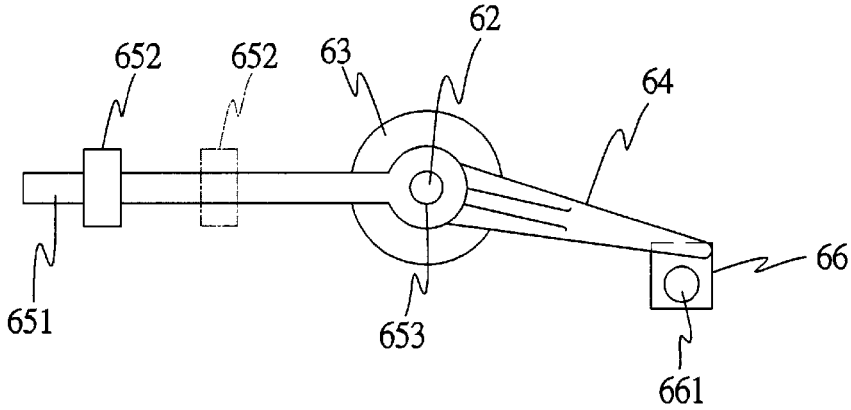
FIG. 11 is cross-sectional view of the preferred embodiment of a weight member adjusted in its position on the weight-distributing rod in the present invention.

In addition, as shown in FIG. 11, the weight member 652 is adjustable in its location on the weight rod 651. If the weight member 652 is positioned closer to the rotating shaft 62, the distance of its arm of force to the central fulcrum becomes shorter and its relative resisting force against the balancing rod 61 becomes small, and in consequence the length or amount of the packaging strap 80 stored in the strap-preserving groove 50 become comparatively short or small.

Contrarily, in case the weight member 652 is moved to a position comparatively far from the rotating shaft 62, the distance of its arm of force to the central fulcrum becomes long and its resisting force against the balancing rod 61 becomes large and hence the length or amount of the packaging strap 80 stored in the strap preserving room 50 become relatively long and large. Thus, the weight member 652 can be adjusted in its position to match with different sizes of articles to be strapped to let the amount of the packaging strap 80 stored in the strap reserving room 50 meets practical needs in strapping.

As can be noted from the above description, this invention has the following advantages.

1. The application of the relative action between the balance weight unit and the balancing rod, and the functions of sensing and detecting of the sensing rod and the sensing switch can effectively control the length or amount of the packaging strap stored in the strap reserving room.
2. The balancing weight unit and the balancing rod are connected on the principle of a lever structure so no tiredness of elasticity or damage may happen to them, not only economizing time and cost in maintenance and repair, but also prolonging the service life of the machine and stably and precisely controlling the length or amount of the packaging strap stored in the strap reserving room.

While the preferred embodiment of the invention has been described above, it will be recognized and understood that various modifications may be made therein and the appended claims are intended to cover all such modifications that may fall within the spirit and scope of the invention.

We claim:

1. A strap reserving control device for a strapping machine comprising:

a strap reserving room consisting of a separating plate and a cover plate combined together with a preset interval;

a balancing rod positioned at a lower side of said strap reserving room;

a rotating shaft fixed perpendicularly on one end of said balancing rod and inserted through a through hole of said separating plate;

a shaft sleeve secured on the outer side of said through hole of said separating plate and provided axially with a shaft hole, said shaft hole being for said rotating shaft to insert therethrough;

a sensing rod bored with a lateral fit hole in one end said fit hole being for said fit portion of said rotating shaft to insert therethrough, said sensing rod fixed on said rotating shaft with combining members and positioned in the same direction as said balancing rod;

a balancing weight unit consisting of a weight rod and a weight member, said weight rod provided with a lateral fit hole at one end, said fit hole receiving said engage portion of said rotating shaft, said weight rod secured on said rotating shaft with a combining member, the respective arm of force of said weight rod and said balancing rod positioned in opposite directions, said rotating shaft acting as a fulcrum between said weight rod and said balancing rod, said weight member able to be positioned at one of many locations on said weight rod; and a sensing switch positioned adjacent to said sensing rod and having a sensing portion at one end, the sensing switch being a proximity switch with a sensing portion on one side, said sensing portion sensing the movement of said sensing rod and said sensing switch sending out a signal, when the sensing rod reaches a predetermined position spaced from the sensing portion, to said strap feed device to start or stop operation, said strap feed device controlled to guide a packaging strap into said strap reserving room or stop guiding it.

2. The strap reserving control device for a strapping machine as claimed in claim 1, wherein said combining members are bolts.

3. The strap reserving control device for a strapping machine as claimed in claim 1, wherein said weight member is bored with a fit hole for said weight rod inserted therein, and said fit hole is provided with a diametrical threaded hole for a bolt to engage therein for adjusting the position of said weight member and fixing it on said weight rod.

* * * * *